US005886423A

United States Patent [19]

Gershen et al.

[11] Patent Number: 5,886,423

[45] Date of Patent: Mar. 23, 1999

[54] ELECTRIC SERIES CIRCUIT

[75] Inventors: Bernard Gershen, Centerport; Stanley S. Brenner, East Northport, both of N.Y.

[73] Assignee: Leviton Manufacturing Co., Inc., Little Neck, N.Y.

[21] Appl. No.: 926,856

[22] Filed: Sep. 10, 1997

[51] Int. Cl.[6] ..... H05B 37/00

[52] U.S. Cl. ..... 301/36; 315/121; 315/122; 315/179; 315/185.5; 327/469

[58] Field of Search ..... 307/36, 130, 116; 315/122, 185 R, 121, 179, 185.5; 257/119; 327/425, 469

[56] References Cited

U.S. PATENT DOCUMENTS

| | | | |
|---|---|---|---|
| 3,535,585 | 10/1970 | Barnum | 307/36 |
| 3,639,805 | 2/1972 | Muench et al. | 315/122 |
| 4,682,079 | 7/1987 | Sanders et al. | 315/179 |
| 4,912,375 | 3/1990 | Mongoven et al. | 315/185 R |
| 5,453,664 | 9/1995 | Harris | 307/116 |

*Primary Examiner*—Albert W. Paladini
*Attorney, Agent, or Firm*—Paul J. Sutton

[57] ABSTRACT

An electric series circuit with plural loads such as light bulbs connected in series and plural solid state switching devices, with each switching device connected in parallel with one of the loads. Each switching device conducts current when the load that it is connected in parallel with does not conduct current because the load is burned out. The solid state switching means may be any device with a breakthrough voltage which is high enough that it does not conduct when all of the loads conduct current normally. When one of the loads is burned out, that load does not conduct current and the entire line voltage appears across the switching means in parallel with the burned out load. The switching means breaks down. Accordingly, the switching means conducts current and current flows to the remaining loads. Accordingly, the remaining light bulbs in a string of light bulbs continue to light. The burned out load may be immediately detected and replaced. The switching means may be a sidac. Alternatively, a combination of an SCR and a zener diode controlling the gate of the SCR are also disclosed as the switching means. A diac may replace the zener diode.

47 Claims, 13 Drawing Sheets

10
12
14
16
18
20
22
24
26
28
30
32
SWITCHING MEANS
SWITCH-ING MEANS
SWITCHING MEANS
SWITCHING MEANS
SWITCHING MEANS
+A
B
C
D
E
F

16
D
C
B
E
F
+A
22
12
14
18
20
34
36
38
24"
26"
28"
30"
32"

16
D
C
B
E
F
+A
22
12
14
18
20
34
36
40
38
24"
26"
28"
30"
32"

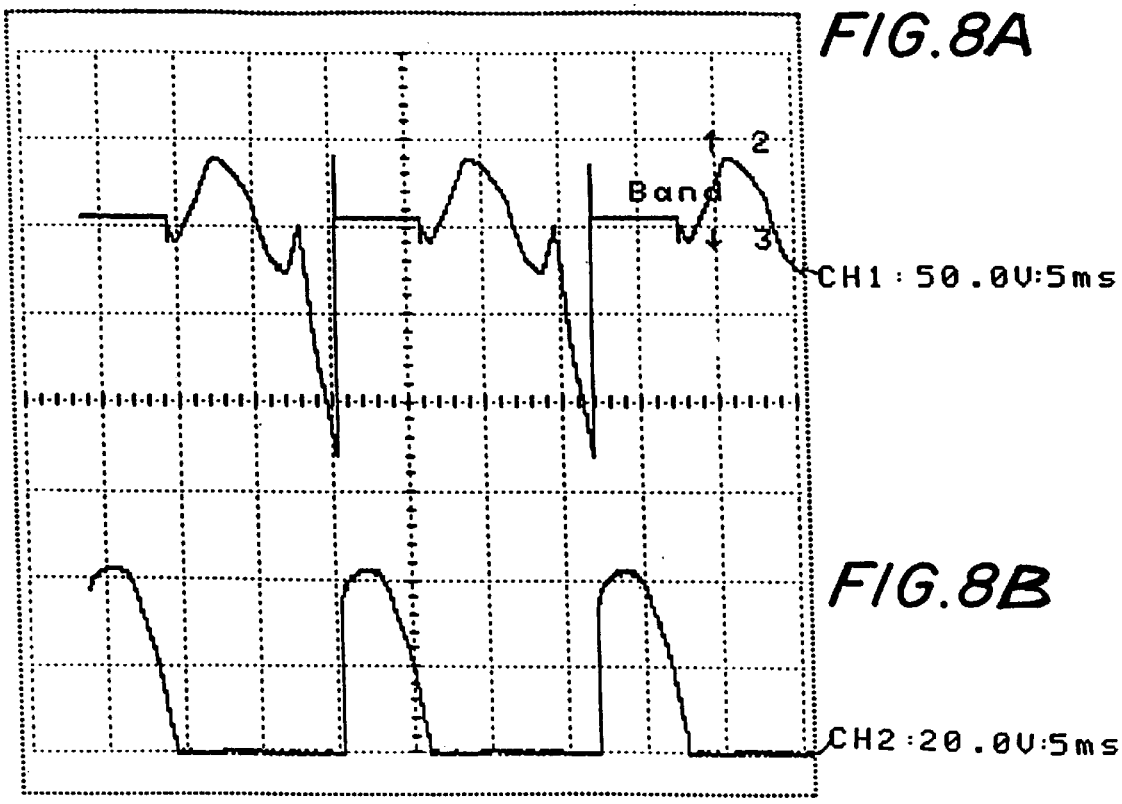
FIG.8A
FIG.8B
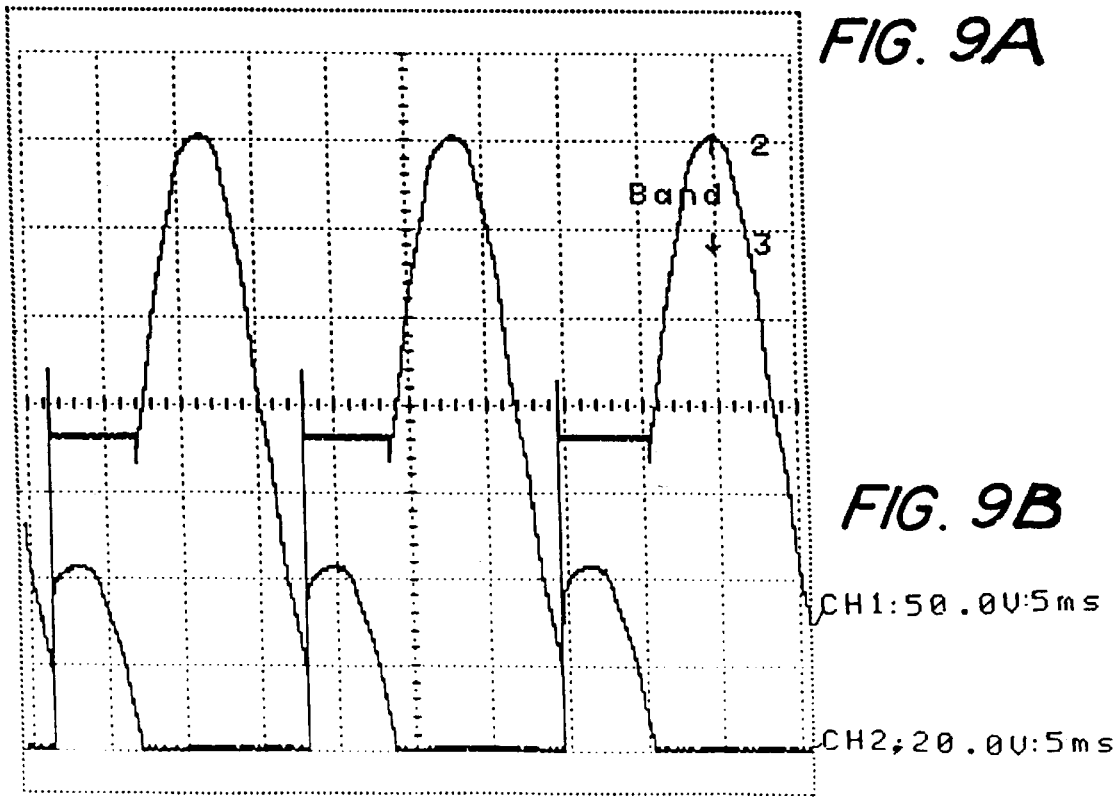
FIG. 9A
FIG. 9B

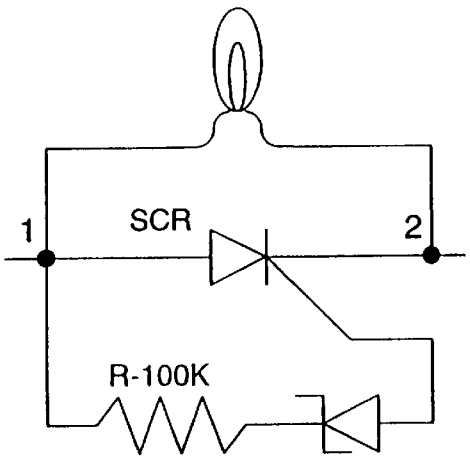
FIG. 12
| NUMBER OF BULBS REMOVED | VOLTAGE ACROSS INDIVIDUAL REMAINING BULBS | | VOLTAGE ACROSS INDIVIDUAL BULBLESS SOCKETS | |
|---|---|---|---|---|
| | MINIMUM | MAXIMUM | MINIMUM | MAXIMUM |
| 1 | 16 | 18 | 63 | 65 |
| 2 | 20 | 22 | 38 | 41 |
FIG. 10
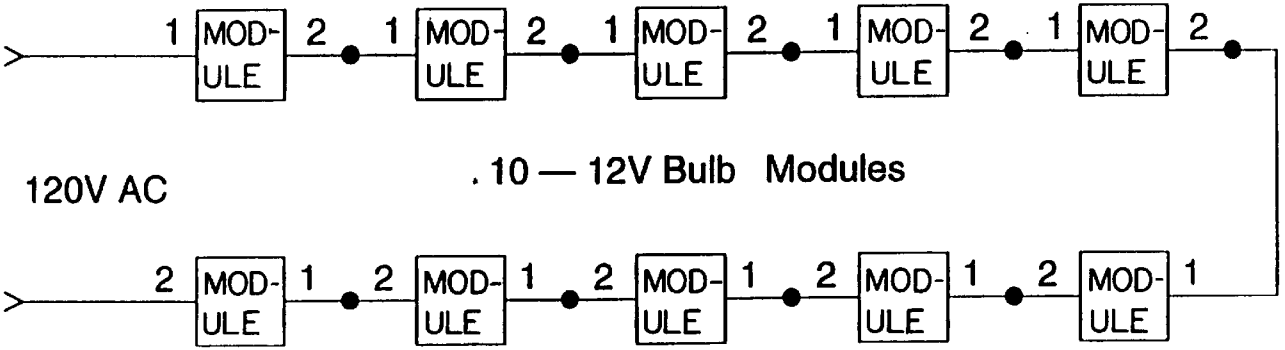
FIG. 11

| NUMBER OF BULBS REMOVED | VOLTAGE ACROSS INDIVIDUAL REMAINING BULBS | | VOLTAGE ACROSS INDIVIDUAL BULBLESS SOCKETS | |
|---|---|---|---|---|
| | MINIMUM | MAXIMUM | MINIMUM | MAXIMUM |
| 1 | 7.0 | 7.8 | 60 | 62 |
| 2 | 8.0 | 8.6 | 34 | 36 |
| 3 | 9.0 | 9.6 | 23 | 26 |
| 4 | 9.7 | 10.3 | 19 | 23 |

FIG. 13

| BULB VOLTAGE | MAXIMUM BULB CURRENT (AMPERES) | MAXIMUM BULB WATTAGE (WATTS) |
|---|---|---|
| 12 | 0.8 | 10 |
| 24 | 0.8 | 20 |

FIG. 14

VOLTAGE READING ACROSS THE 24V BULBS; 5 MODULES IN SERIES

ONE BULB OFF: BULB #5

| LINE V | BULB#1 ON | BULB# 2 ON | BULB# 3 ON | BULB#4 ON | BULB# 5 ON |
|---|---|---|---|---|---|
| 108 V | 15V | 15V | 15V | 15V | 64V |
| 120 V | 17V | 17V | 17V | 17V | 70V |
| 132 V | 18V | 18V | 18V | 18V | 76V |

TWO BULBS OFF: BULBS # 4,5

| LINE V | BULB#1 ON | BULB# 2 ON | BULB# 3 ON | BULB#4 ON | BULB# 5 ON |
|---|---|---|---|---|---|
| 108 V | 16V | 16V | 16V | 44V | 40V |
| 120 V | 21V | 21V | 21V | 40V | 39V |
| 132 V | 24V | 24V | 24V | 43V | 40V |

FIG. 15A

VOLTAGE READING ACROSS THE 12V BULBS: 10 MODULES IN SERIES

ONE BULB OFF: BULB # 10

| LINE V | BULB # 1 ON | BULB # 2 ON | BULB # 3 ON | BULB # 4 ON | BULB # 5 ON | BULB # 6 ON | BULB # 7 ON | BULB # 8 ON | BULB # 9 ON | BULB # 10 OFF |
|---|---|---|---|---|---|---|---|---|---|---|
| 108 V | 6.6 V | 6.6V | 6.8 V | 6.6V | 6.7V | 6.6V | 6.8V | 6.7V | 6.4V | 61V |
| 120 V | 7.4 V | 7.3V | 7.5V | 7.3V | 7.4V | 7.3V | 7.6V | 7.5V | 7.2V | 68V |
| 132 V | 8.1 V | 7.9V | 8.2 V | 8.0V | 8.1V | 7.9V | 8.2V | 8.2V | 7.8V | 74V |

TWO BULBS OFF: BULBS # 9, 10

| LINE V | BULB # 1 ON | BULB # 2 ON | BULB # 3 ON | BULB # 4 ON | BULB # 5 ON | BULB # 6 ON | BULB # 7 ON | BULB # 8 ON | BULB # 9 ON | BULB # 10 OFF |
|---|---|---|---|---|---|---|---|---|---|---|
| 108 V | 7.5V | 7.4V | 7.7V | 7.3V | 7.5V | 7.3V | 7.6V | 7.5V | 31V | 32V |
| 120 V | 8.3V | 8.1V | 8.5V | 8.2V | 8.3V | 8.2V | 8.5 V | 8.2V | 35V | 35V |
| 132 V | 9.0V | 8.9V | 9.2V | 8.9V | 9.1V | 8.9V | 9.3V | 9.0V | 37V | 38 V |

THREE BULBS OFF: BULBS # 8, 9, 10

| LINE V | BULB # 1 ON | BULB # 2 ON | BULB # 3 ON | BULB # 4 ON | BULB # 5 ON | BULB # 6 ON | BULB # 7 ON | BULB # 8 ON | BULB # 9 ON | BULB # 10 OFF |
|---|---|---|---|---|---|---|---|---|---|---|
| 108 V | 8.3V | 8.2V | 8.4V | 8.2V | 8.3V | 8.2V | 8.6V | 24V | 23V | 23V |
| 120 V | 9.4V | 9.2V | 9.5V | 9.3 V | 9.3V | 9.1V | 9.5V | 25V | 24V | 24V |
| 132 V | 10.3 V | 10.1 V | 10.4V | 10.3V | 10.4V | 10.1V | 10.5V | 27V | 26V | 26V |

FOUR BULBS OFF: BULBS # 7, 8, 9, 10

| LINE V | BULB # 1 ON | BULB # 2 ON | BULB # 3 ON | BULB # 4 ON | BULB # 5 ON | BULB # 6 ON | BULB # 7 ON | BULB # 8 ON | BULB # 9 ON | BULB # 10 OFF |
|---|---|---|---|---|---|---|---|---|---|---|
| 108 V* | NA | NA | NA | NA | NA | NA | NA | NA | NA | NA |
| 120 V | 9.8V | 9.9V | 10.2V | 10.1V | 10.2V | 9.9V | 21V | 22V | 20V | 20V |
| 132 V | 11.5V | 11.4V | 11.6V | 11.5V | 11.5V | 11.3V | 21V | 23V | 22 V | 22.V |

* CIRCUIT TURNS ON AT 115V

FIG. 15B

ELECTRIC SERIES CIRCUIT

FIELD OF THE INVENTION

This invention relates to an electric circuit with plural loads connected in series, and more particularly, the invention relates to a series circuit that permits a burned out load in a series to be identified for replacement.

BACKGROUND OF THE INVENTION

Electrical series circuits such as a series circuit of low voltage light bulbs are known. Low voltage loads such as light bulbs may be connected in series to built up to a normal line voltage. This is the usual "Christmas Tree" light string scheme. However, if one bulb burns out, the whole string will extinguish. For Christmas tree lights, this is not a big problem, because the strings of lights are inexpensive and can be easily discarded and replaced. There are some types of these string lights which are intended to continue to light even if some bulbs are extinguished. They make use of a spring as one of the terminals connecting to the bulb filament. The spring keeps the filament in tension. When the filament burns out, the spring travels and makes contact with the other terminal for the filament, thus shorting that bulb out. No provision is made for keeping the voltage across the remaining bulbs from increasing. This increase of voltage could cause premature burnout of other bulbs. As at least a partial offset it might be possible to start with a minimum operating voltage so that the burnout of a small number of bulbs can be tolerated.

In the 1920's and 30's municipalities employed series circuits for street lights in order to save on the cost of copper. To avoid the opening of the whole series circuit if one of the lamps should burn out, the lamps in a high voltage series circuit are provided with by-pass protectors connected in parallel with them. Current regulators were employed to provide constant current even if one light was burned out. If one of the lamps should burn out, the full voltage of the series circuit is then impressed on the by-pass protector. The excessive voltage breaks down the insulating film in the by-pass protector which then becomes conducting and permits the remainder of the circuit to continue in operation.

In other lighting applications, the by-pass protector was a thin disc of paper held between a pair of contacts in parallel with a light bulb for each bulb connected in a series circuit. The thin paper acted as insulation between the contacts and current flowed through each light bulb to light the bulb. Only about a hundred Volts appeared across each bulb which was not enough to burn through the thin paper. However, if a bulb burned out, 5–10 K Volts would appear across the contacts and burn out the thin paper so that the contacts would make a connection. Consequently, current would flow in a path parallel to the burned out light bulb and the remaining bulbs would light. A current regulator would ensure that the remaining bulbs would operate at their previous voltage.

The above electric series circuits do not provide an adequate solution to the problem of an entire string of series connected loads such as light bulbs becoming extinguished when one load burns out for most applications. In many lighting applications, it is not possible to bear the cost of discarding the string of series connected bulbs. It is undesirable for the life of the remaining bulbs to be significantly decreased. Further current regulators are expensive and bulky for low voltage lighting applications. Additionally, insulating film by-pass protectors are not appropriate for low voltage lighting. Further, inserting discs of thin paper in electric circuits is not practical nor effective enough to meet modem standards for low voltage electric lighting.

There is, therefore, a need for an electric series circuit for low voltage loads such as light bulbs in which current flows through the plural light bulb loads connected in series even if one or more of the loads bums out, in order to identify the burned out load or loads for replacement. Further, there is a need for an electric series circuit which is practical for use in modem lighting applications. There is a need for an electric series circuit that permits current to flow through the light bulb loads that are not burned out and which does not significantly reduce the life of the remaining bulbs. Additionally, there is a need for an electric series circuit which is simple in construction and inexpensive and which permits current to flow through a string of series connected loads such as light bulbs when one or more loads have burned out. There is a need for an electric series circuit for assuring current flow to a string of series connected loads such as light bulbs when one bulb burns out which does not require a current regulator. There is a need for an electric series circuit that permits current to flow to a string of series connected loads when one load stops conducting current for low voltage loads. There is a need for a transformerless low voltage electric series circuit.

OBJECTS AND SUMMARY OF THE INVENTION

It is an object of the invention to provide an electric series circuit for plural loads connected in series that assures current flow to all the remaining loads even when one load does not conduct current.

It is another object of the invention to provide an electric series circuit for plural loads connected in series that assures current flow to a string of loads even when one or more loads does not conduct current that is simple in construction and inexpensive.

It is a further object of the invention to provide an electric series circuit for plural loads connected in series that is practical to use and meets modern electric standards for lighting applications and which assures current flow to the remaining loads in the series when one or more loads does not conduct current.

It is still a further object of the present invention to provide an electric series circuit for plural loads connected in series that assures current flow to the remaining loads when one or more loads does not conduct current which is practical to use and which does not require a bulky and expensive current regulator and which can be used for low voltage loads.

It is yet another object of the invention to provide an electric series circuit for a string of light bulbs connected in series that permits the remaining light bulbs to light at a reduced level when one light bulb burns out so that the burned out light bulb can be immediately identified and replaced.

It is still another object of the present invention to provide lighting even if one or more bulbs burn out in an electric series circuit so that the area served by the bulbs is not thrown into complete darkness.

These and other objects of the invention are accomplished by providing an electric circuit comprising plural loads connected in series, and plural solid state switching means, each switching means connected in parallel with one of the loads, wherein each switching means conducts current when the load that it is connected in parallel with does not conduct current.

In another embodiment of the invention a method of powering plural low voltage loads connected in series even if one or more loads stops conducting current comprises connecting solid state switching means in parallel with each low voltage load, and conducting current through one of the switching means to pass current to the remaining loads when a load in parallel with the switching means stops conducting current.

The above and other objects, aspects, features and advantages of the invention would be more readily apparent from the description of the preferred embodiments taken in conjunction with the accompanying drawings and appended claims.

BRIEF DESCRIPTION OF THE DRAWINGS

The invention is illustrated by way of example and not limitation in the figures of the accompanying drawings in which like references denote like and corresponding parts and in which:

FIG. 8A illustrates the sidac voltage vs. time for the circuit of FIG. 2;

FIG. 8B illustrates the lamp voltage vs. time for the circuit of FIG. 2;

FIG. 9A illustrates the sidac and diode combination voltage vs. time for the circuit of FIG. 6;

FIG. 9B illustrates the lamp voltage vs. time for the circuit of FIG. 6;

FIG. 10 is a chart of the voltage across individual sockets containing bulbs compared to the voltage across individual bulbless sockets based upon the number of 24 Volt bulbs removed from the series circuit of the instant invention.

FIG. 11 is a schematic representation of 10–12 Volt bulb modules in series.

FIG. 12 is an electrical schematic of another embodiment of a module using a SCR and zener diode switching means.

FIG. 13 is a chart of the voltage across individual sockets containing bulbs compared to the voltage across individual bulbless sockets based upon the number of 12 Volt bulbs removed from the series circuit of the instant invention.

FIG. 14 is a chart listing the maximum bulb current and voltage for 12V and 24V bulbs.

FIG. 15A is a chart of the measured voltage across the five 24 Volt modules with one bulb off and with two bulbs off.

FIG. 15B is a chart of the measured voltage across the ten 12 Volt modules with one, two, three and four bulbs off.

DESCRIPTION OF THE PREFERRED EMBODIMENTS

Figure 1:
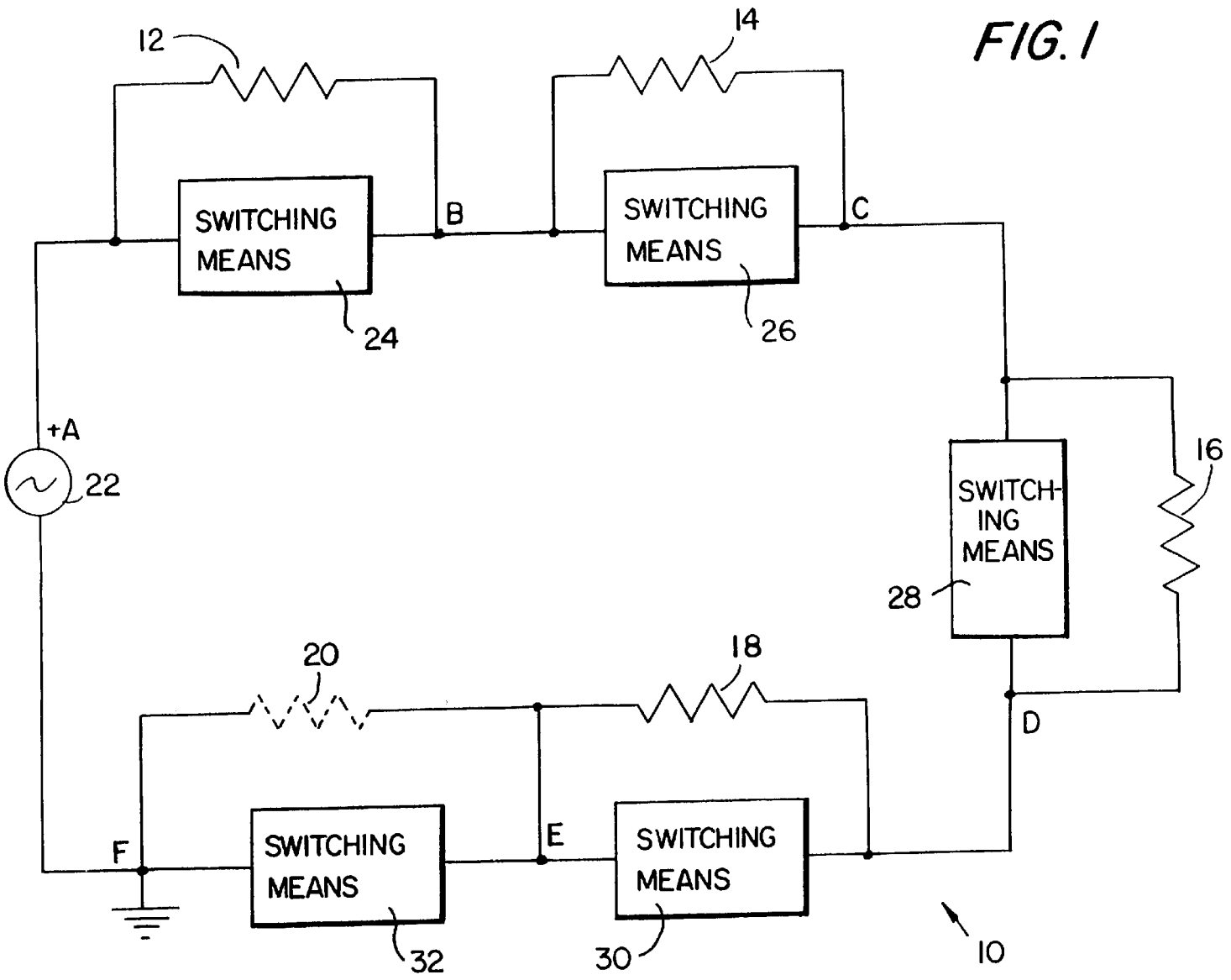
FIG. 1 is an electrical schematic diagram of the electric circuit with plural loads connected in series in accordance with the present invention.

Referring to FIG. 1, an electric circuit with plural loads connected in series is shown.

The electric circuit according to the invention, as shown in FIG. 1, comprises plural loads 12, 14, 16, 18 and 20 connected in series across a voltage source 22 of voltage +A which may be 120 Volts, for example. The actual voltage may be in the range of 10% below nominal (120V) to 10% above nominal. Load 20 is represented with dotted lines to indicate that it does not conduct current due to a burned out filament, for example. Loads 12, 14, 16, 18 and 20 are represented as resistors. The loads may be light bulbs such as low voltage light bulbs having a low impedance. For example, five 12 Volt bulbs can be used across a 120 Volt source 22 if a series diode is introduced in series with each bulb. If no series diodes are employed, 10 light bulb loads of 12 Volts each are used for a 120 Volt source 22. Alternatively, as illustrated in FIG. 1, five 24 Volt bulbs are employed across a 120 Volt source 22.

The load light bulb 20 is burned out as illustrated in FIG. 1 by dotted lines. Accordingly, the entire supply voltage of 120 Volts from source 22 appears across the terminals for load light bulb 20. A voltage of 120 Volts appears across nodes E and F. Also illustrated in FIG. 1 are switching means 24, 26, 28, 30 and 32. When 120 Volts appears across nodes E and F because load light bulb 20 has burned out, switching means 32 begins to conduct current. Accordingly, the burned out state of load light bulb 20 does not open the circuit and current still flows through the remaining load light bulbs 12, 14, 16 and 18. Thus, the remaining load light bulbs 12, 14, 16 and 18 remain lit at a reduced level which permits the burned out load light bulb 20 to be immediately identified for replacement. Thus, the invention permits the series electric circuit to operate with one light bulb burned out. More than one load light bulb could be burned out and the circuit will still operate, however, extra stress is placed on the remaining load light bulbs.

The number of bulbs to use N in a string of bulbs equals:

$$N = \text{total line voltage/bulb voltage.}$$

$$N = 120V/24V = 5 \text{ for the circuit in FIG. } 1,$$

where the bulb voltage of each bulb is the same.

Switching means 24, 26, 28, 30 and 32 are solid state devices which do not conduct current when a low voltage such as 12–24 Volts is applied across the terminals of the device. However, when a high voltage such as line voltage (120 V) appears across the terminals of the solid state devices, they conduct current. Thus, switching means 24, 26, 28, 30 and 32 are ideally solid state switching devices which have IV (current-voltage) characteristics which include a breakthrough voltage $V_T$ where current conducts. When the load light bulb (such as load light bulb 20) stops conducting current (because it burns out), the entire supply voltage from source 22 appears across the terminals of the solid state switching means 32. The breakdown voltage of the switching means 32 is reached and the switching means 32 conducts current.

The electric circuit of the present invention employing solid state devices as switching means is ideal for low voltage lighting applications. Circuits for chandeliers are such an application. Other applications include under cabinet lighting, strip lighting, emergency lighting, lights for the aisles of theaters like movie theaters, and lights for use in exit signs, for example. In low voltage lighting, a series circuit of load light bulbs across a voltage supply eliminates the need for a step down transformer, which is bulky, or the use of high frequency lighting, which generates interference and noise on the line. Instead, a series of low voltage load light bulbs are connected in series for the use in lighting fixtures and other applications. The low voltage is appropriate for the use of solid state electronics.

Figure 2:
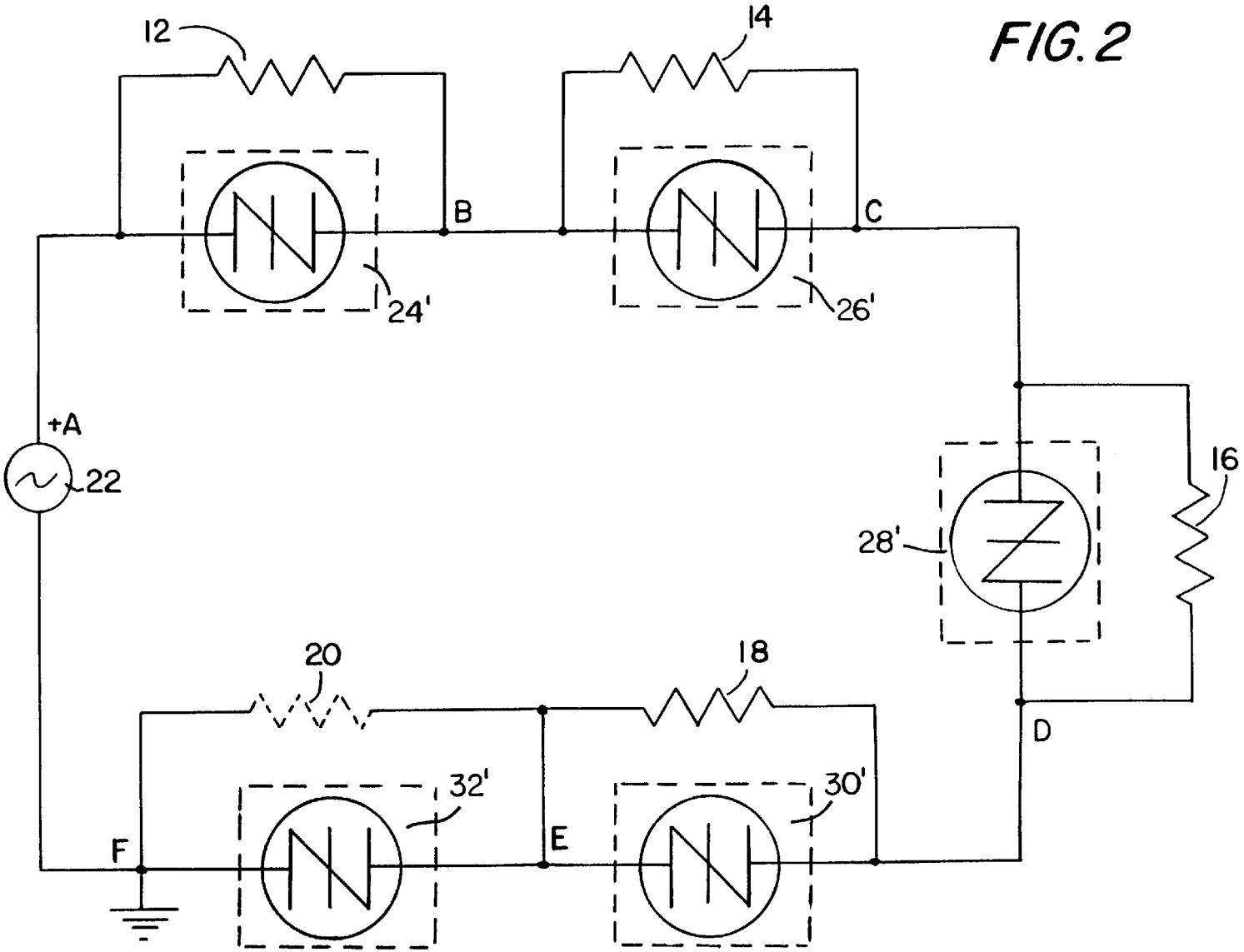
FIG. 2 is an electrical schematic diagram of an electric circuit with plural loads connected in series employing sidacs for switching means in accordance with one embodiment of the present invention.
Figure 5:
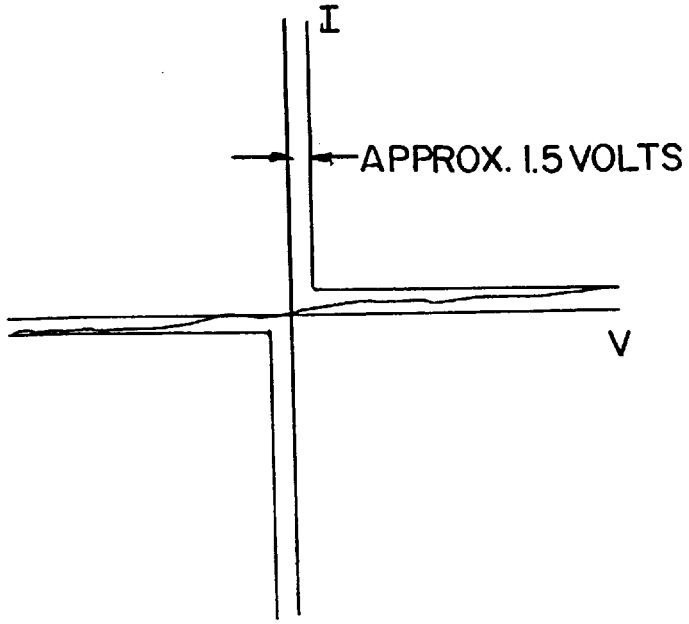
FIG. 5 is a curve of the IV characteristics of the sidacs employed in the electric circuit illustrated in FIG. 2.

FIG. 2 illustrates the electric circuit with plural loads connected in accordance with a first embodiment of the present invention. In FIG. 2 the switching means are solid state devices known as sidacs. Each sidac 24', 26', 28', 30' and 32' is illustrated within the dotted lines. The sidacs employed in the first embodiment illustrated in FIG. 2 have IV (current-voltage) characteristics as illustrated in FIG. 5. A sidac is a solid state device which is two directional as illustrated in FIG. 5. The IV characteristics of a sidac are symmetrical. When a breakthrough voltage $V_T$ is reached current conducts, however, as current increases there is a sudden decrease in voltage from the breakthrough voltage $V_T$ in both the forward and reverse directions. The breakthrough voltage $V_T$ is reached across the terminals of a switching device such a sidac 32' when load light bulb 20 bums out and the entire supply voltage from voltage-source 22 appears across nodes E and F and across the sidac 32'. When the breakthrough voltage $V_T$ is reached, sidac 32' conducts current so the remaining load light bulbs 12, 14, 16 and 18 remain lit. As illustrated by the IV curve of FIG. 5, after the sidac 32' reaches the breakthrough voltage $V_T$, the voltage across sidac 32' decreased substantially. As the current increases, a small voltage of 2–3 volts appears across the sidac 32' while it conducts current. Thus, most of the voltage from the supply voltage source 22 appears across the remaining four load light bulbs 12, 14, 16 and 18. The sidacs 24', 26', 28', 30' and 32' may be components manufactured by Teccor. The sidac in the TO-92 configuration is one such device for 95–170 Volt applications. The sidacs are connected at the socket of each load light bulb in the series string.

Figure 3:
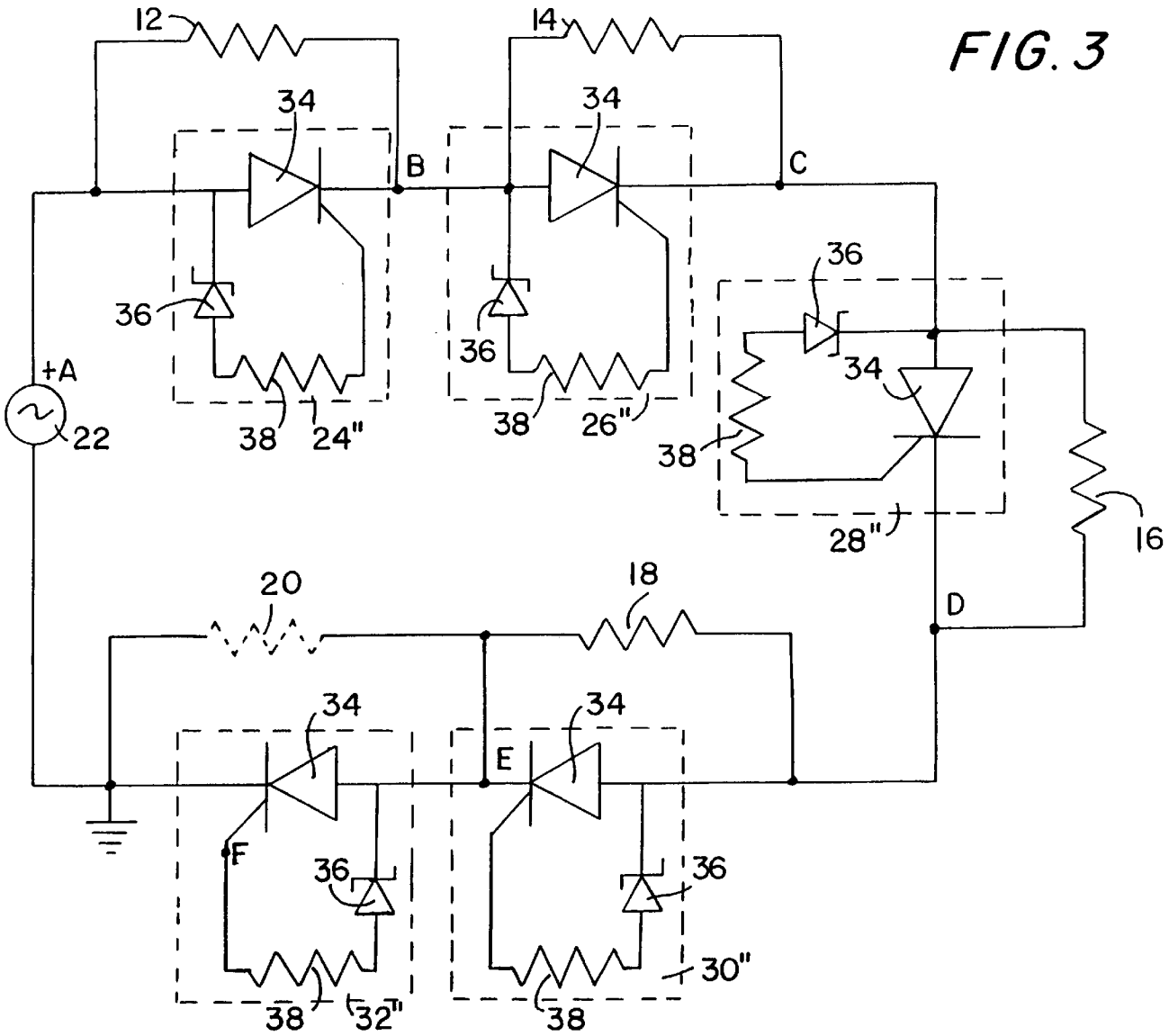
FIG. 3 is an electrical schematic diagram of an electric circuit with plural loads connected in series with an SCR and zener diode combination for switching means in accordance with a second embodiment of the present invention.
Figure 4:
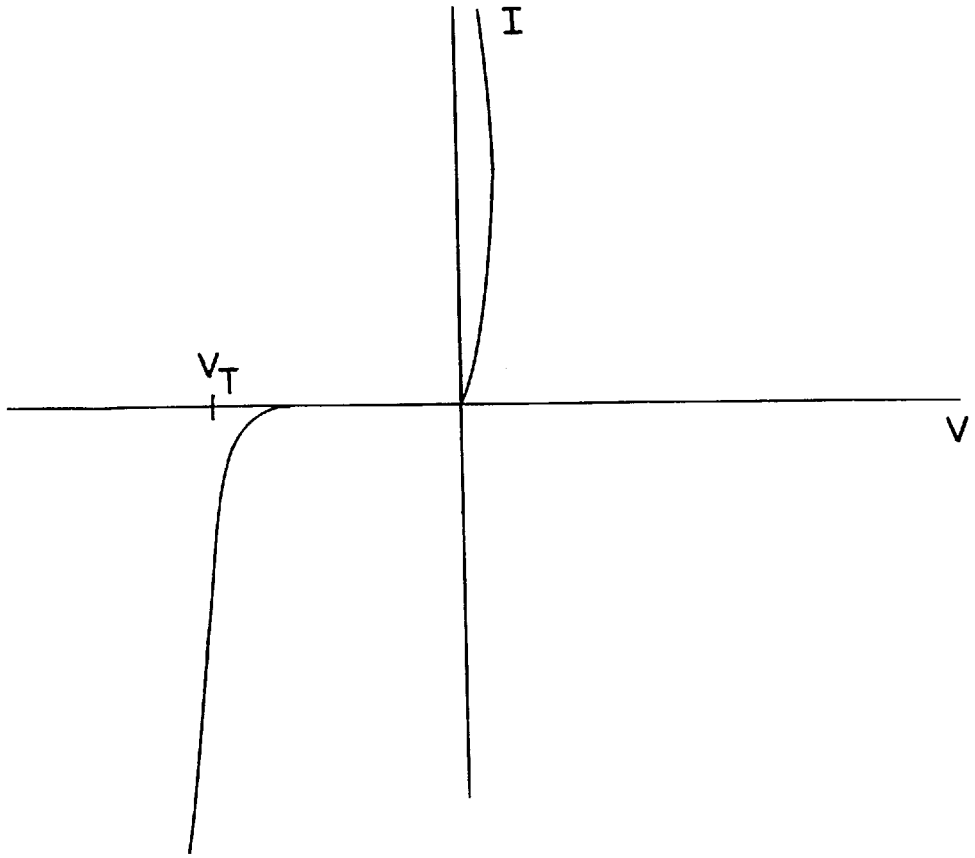
FIG. 4 is a curve of the IV characteristics of the zener diode employed in the electric circuit illustrated in FIG. 3.

FIG. 3 illustrates a second embodiment of the electric circuit with plural loads connected in series of the present invention. In FIG. 3 the switching means are illustrated as silicon controlled rectifier (SCR) and zener diode combinations. As illustrated in FIG. 3, each switching means 24", 26", 28", 30" and 32" includes a silicon controlled rectifier SCR 34, a zener diode 36 and resistor 38. The silicon controlled rectifier 34 is connected parallel to the load light bulb. The anode of the SCR 34 is at a higher voltage than the cathode of the SCR. Thus, for example, SCR 34 of switching means 24" has an anode connected to the +A terminal of the voltage source 22 and a cathode connected to node B. Zener diode 36 is connected between the gate of the SCR 34 and the anode of the SCR 34. The cathode of zener diode 36 is connected to the anode of SCR 34 and the anode of the zener diode 36 is connected to the gate of the SCR 34 through a current limiting resistor 38. The zener diode 36 has a breakdown voltage of 100 Volts. FIG. 4 illustrates the IV (current-voltage) characteristics of zener diode 36. $V_T$ in FIG. 4 is 100 Volts.

The use of a unidirectional device such as SCR 34 is preferred over the use of a bi-directional devices, such as the sidacs 24', 26', 28', 30' and 32' because when any bulb burns out, the remaining bulbs receive half wave current and voltage and the RMS voltage drops below the nominal operating voltage of the bulbs. This insures that the life of bulbs remaining on will not be reduced during the time they are on before a good replacement bulb is found.

In operation, when none of the load light bulbs 12, 14, 16, 18 and 20 are burned out (all light bulbs are lit), the 120 Volts from voltage supply 22 is distributed across the series circuit. Therefore, about 24 Volts appear across each switching means 24", 26", 28", 30" and 32". This voltage is not sufficient for breakthrough of zener diode 36. Further, SCR 34 does not conduct until a current appears at its gate. However, there is no current at the gate of SCR 34 until zener diode 36 breaks down and conducts.

When load light bulb 20 burns out, the entire 120 Volts from voltage supply 22 appears across nodes E and F. Thus, over 100 Volts appear across zener diode 36. Consequently, zener diode 36 breaks down and conducts in the reverse direction generating a current at the gate of SCR 34. SCR 34 begins to conduct permitting current to flow through the remaining load light bulbs 12, 14, 16, and 18 so that they remain lit.

The SCR 34 may be component number 2N5064. The zener diode 36 may be component number 1N5378 with a 100 Volt breakthrough voltage. Load light bulbs 12, 14, 16, 18 and 20 are represented as resistors. The resistance of the load light bulbs may be 48 Ohms.

In a prototype of FIG. 3, the SCR 34 is a sensitive gate 0.8 amp element like Part Number, OX-36911-89-00-00 from Leviton Manufacturing Co., Inc. the assignee of the present invention. The resistor 38 is a 100 kohm, ¼ watt resistor and the zener diode 36 is a 62 Volt, 250 MW (minimum) element.

The sidacs 24', 26', 28', 30' and 32' conduct in both directions. Even though the sidac does not begin to conduct until the voltage across it exceeded its breakdown voltage, thus reducing the voltage across the remaining lamps. Experiments have shown that the "true RMS voltage" across each of the remaining lamps was at the high end of the maximum rated lamp voltage. One solution is to include a diode in series with each sidac, so the combination would conduct in only one direction. This is not necessary in the circuit of FIG. 3 since SCR 34 conducts in only one direction.

When zener diode 36 conducts in the reverse direction due to load light bulb 20 burning out, the voltage across zener diode 36 is greater than 100 Volts. Accordingly, the voltage across the remaining load light bulbs 12, 14, 16 and 18 is less than 24 Volts. Accordingly, the remaining bulbs still light at a reduced level. The burned out load light bulb 20 may be immediately identified for replacement. Continued operation with the burned out light bulb is permitted.

$I_{Bmax} \leqq I_{SCRmax}$; where $I_{Bmax}$ is the maximum bulb current and $I_{SCRmax}$ is the maximum SCR current.

$V_{Tz}>V_{Pb}$, where $V_{Tz}$ is the zener breakdown voltage and $V_{Pb}$ is the peak voltage across any bulb before burnout.

As discussed above, the sidacs 24', 26', 28', 30' and 32' of FIG. 2 have the IV characteristics as illustrated in FIG. 5. After the breakdown voltage $V_T$ is reached in the sidacs, the voltage significantly drops as current increases. This differs from the operation of the zener diodes 36 of FIG. 3 which have the IV characteristics as illustrated in FIG. 4.

Other solid state circuits and/or components may be employed for the solid state switching means 24, 26, 28, 30 and 32 of FIG. 1.

A halfwave sidac could be used. Such a component would reduce the RMS voltage when one or more bulbs are burned out with the result that the voltage would remain within the limits of the ratings for the remaining bulbs.

Figure 6:
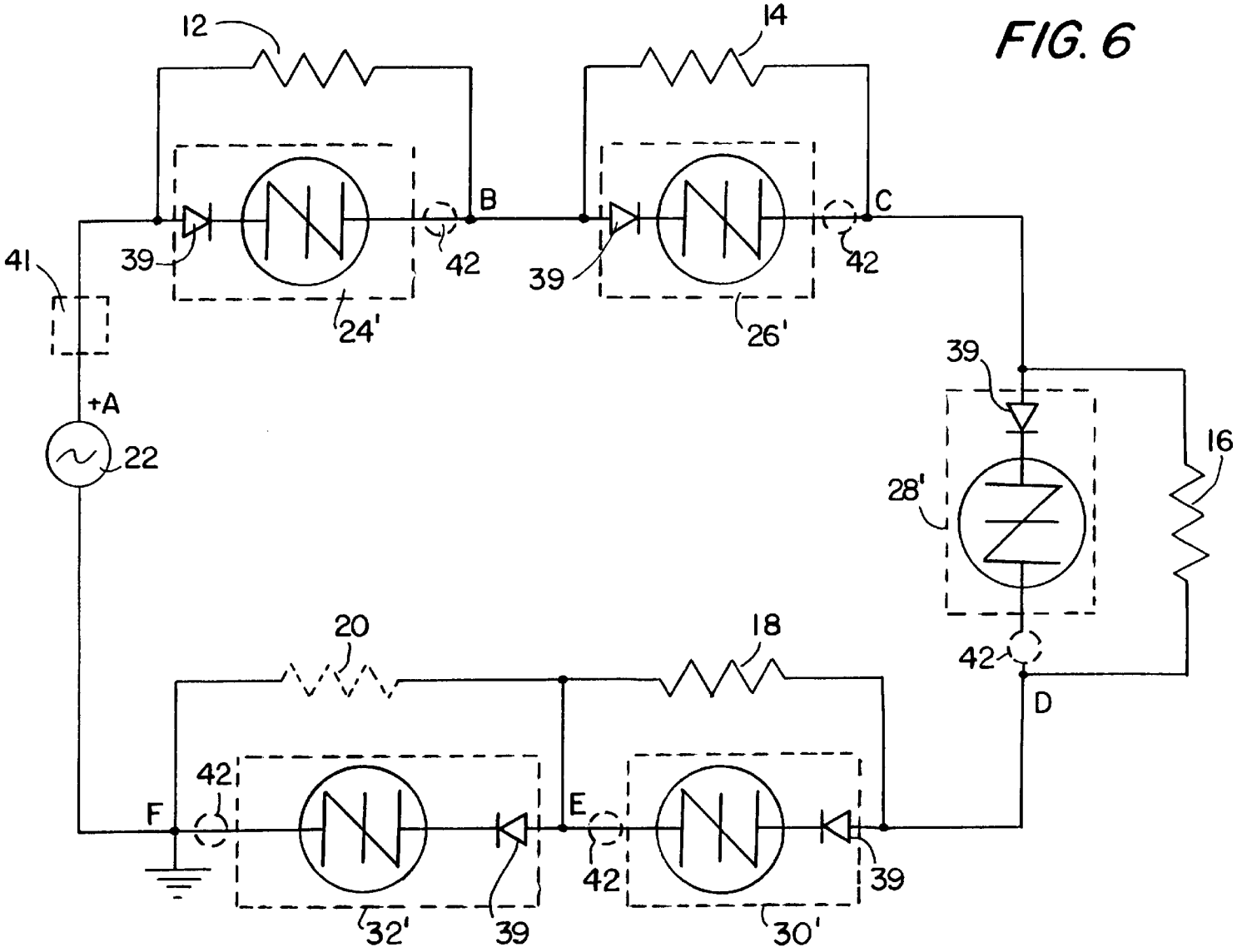
FIG. 6 is an electrical schematic diagram of an electric circuit with plural loads connected in series employing sidacs in series with diodes for switching means in accordance with another embodiment of the present invention.
Figure 7:
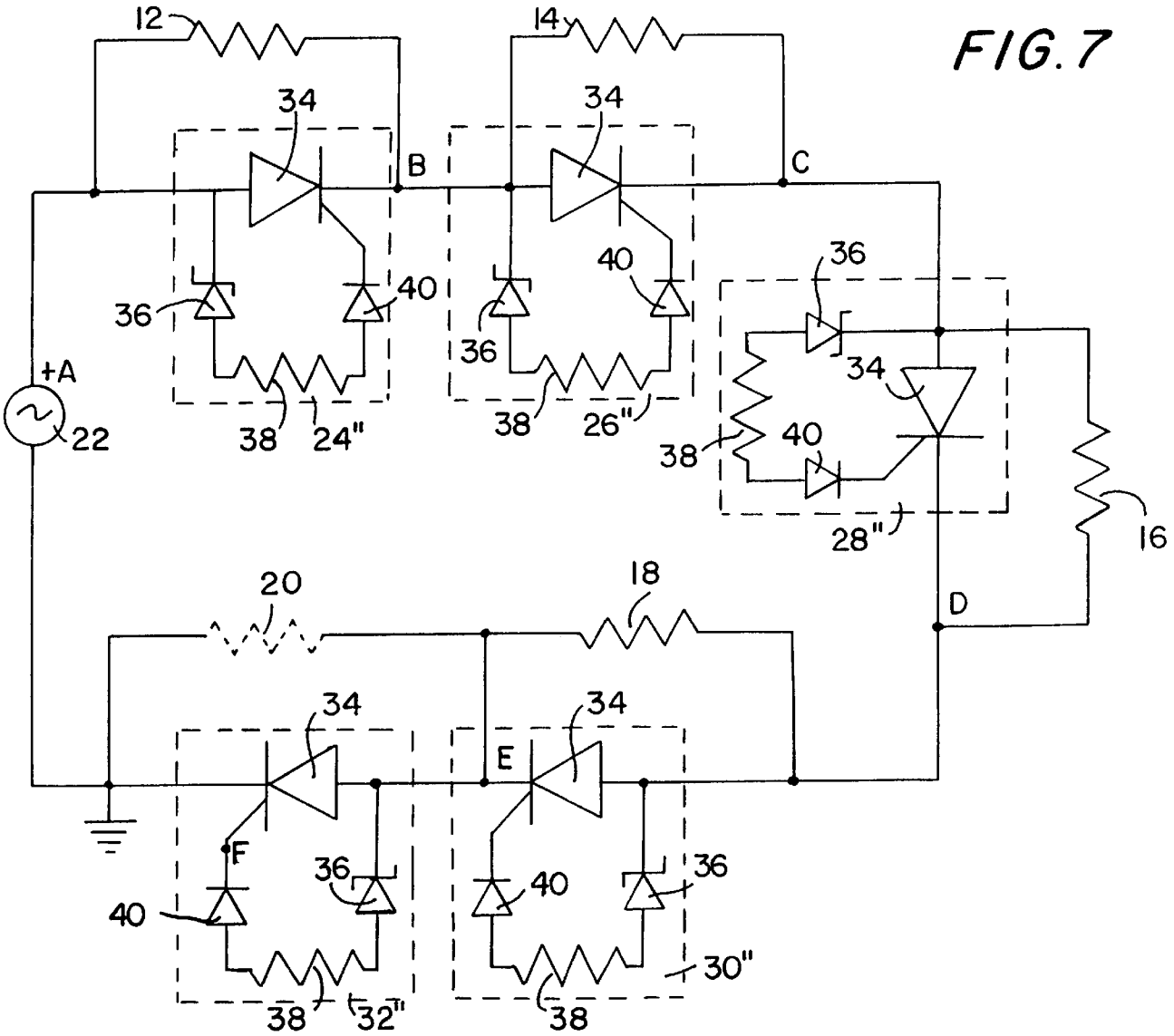
FIG. 7 is an electrical schematic diagram of an electric circuit with plural loads connected in series with an SCR, zener diode and series diodes combination for switching means in accordance with another embodiment of the present invention.

Alternatively, a diode 39 could be placed in series with the sidac as illustrated in FIG. 6. In another alternative, a diode 40 could be placed at the gate of the SCR in series with the zener diode as illustrated in FIG. 7. The diode 40 keeps from breaking down the gate cathode function of the SCR when the anode voltage polarity is negative. The diodes decrease the RMS voltage and avoid excess voltage across the remaining bulbs to increase the life of the bulbs.

In FIG. 3, the zener diodes 36 could be replaced with the diacs. The sum of the bulb voltages must equal the total line voltage, 120 Volts here. The circuit requires that the current through each bulb be the same, since current must be constant in a series circuit. The line voltage could be, 110, 220 or 240 Volts as long as the sum of the bulb voltages equals the line voltage.

One or more visual or audible indicators may be employed in the circuit to indicate when one or more bulbs are burned out, so that the user knows to look for the burned out bulb(s) to replace it (them). Early replacement of burnt out bulbs increases the life of the remaining bulbs. Preferably, the indicator does not signal until two or more bulbs burn out so as not to be a disturbance when only one bulb is out. The lighting is already disturbed if two or more bulbs go out such that a further disturbance by an indicator signaling that it is time to change the bulbs may be appropriate.

The indicator may be a visual indicator such as a lamp, an LED, a neon lamp, a liquid crystal, or an audible indicator such as a buzzer or an annuciator. For example, the indicator may be a piezo electric transducer. Either a visual or audible indicator may be of a variety that includes blinking circuitry built in that intermittently turns the indicator on and off. The indicator may be placed in series with the switching means as illustrated as reference numeral 41 in FIG. 6. Alternatively, a separate indicator may be placed in series with or across each switching means as illustrated as reference numerals 42 in FIG. 6. Appropriate circuitry for the indicator accompanies each indicator in accordance with known techniques.

FIG. 8A illustrates the voltage waveform for a sidac in series with a diode vs. time for the circuit of FIG. 6. FIG. 8B illustrates the positive bulb voltage waveform vs. time for the circuit of FIG. 2. FIGS. 9A and 9B are waveforms for the circuit of FIG. 6 without the optional indicators 41 and 42. FIG. 9A illustrates the voltage waveform across the sidac and diode vs. time for the circuit of FIG. 6. FIG. 9B illustrates the positive bulb voltage waveform vs. time for the circuit of FIG. 6.

A five-24 Volt bulb circuit in accordance with FIG. 3 was constructed for a 120V, 60 Hz source. Either one or two bulbs may burn out and the remaining bulbs are functional, thus giving the user information as to which bulbs have burned out and not shutting down the remaining bulbs. All bulbs in the circuit had the same current rating, power rating, and candle power rating. Any replacement bulb is identical to the remaining bulbs. The type of bulbs to be used are 2860X-2 THHC Lighting bulbs or the equivalent. All measurements were made with a true RMS meter. FIG. 10 is a chart showing the voltages when one and two bulbs are removed (simulating burn out).

FIG. 11 illustrates a ten-12 Volt bulb circuit similar to the circuit of FIG. 3 but with more bulbs in series and lower voltage bulbs. Each module is as illustrated in FIG. 12. In the case of the circuit of FIG. 11, one, two, three or four bulbs can burn out and the remainder are still functional. All bulbs in the circuit constructed had the same current rating, power rating, and candle power rating as before. The type of bulbs to be used are 1250X-2-THHC Lighting bulbs or the equivalent. Any replacement bulb is identical to the remaining bulbs. All measurements were made with a true RMS meter. FIG. 13 is a chart showing the voltages when one, two, three and four bulbs are removed (simulating burn out). The SCR is Part No. OX-36911-89-00-00 from Leviton Manufacturing Co., Inc., the assignee of the present invention. The resistor is a 10 Kohm, ¼ watt resistor and the zener diode is a 60V zener.

FIG. 14 gives the maximum bulb wattage/current ratings for the five-24 Volt bulb and ten-12 Volt bulb circuits constructed.

FIG. 15A is a chart showing the voltage readings across the five 24 Volt bulbs of the circuit of FIG. 3 with one and two bulbs off. FIG. 15B is a chart sharing the voltage readings across the ten 12 Volt bulbs of the circuit of FIG. 11 with one, two, three and four bulbs off.

The various load light bulbs, for example, bulbs 12, 14, 16, 18 and 20, can be at separate locations spaced apart from one another or may be concentrated in a single device such as chandelier which contains all of the load light bulbs, each wired in series with the remaining bulbs.

Figure 16:
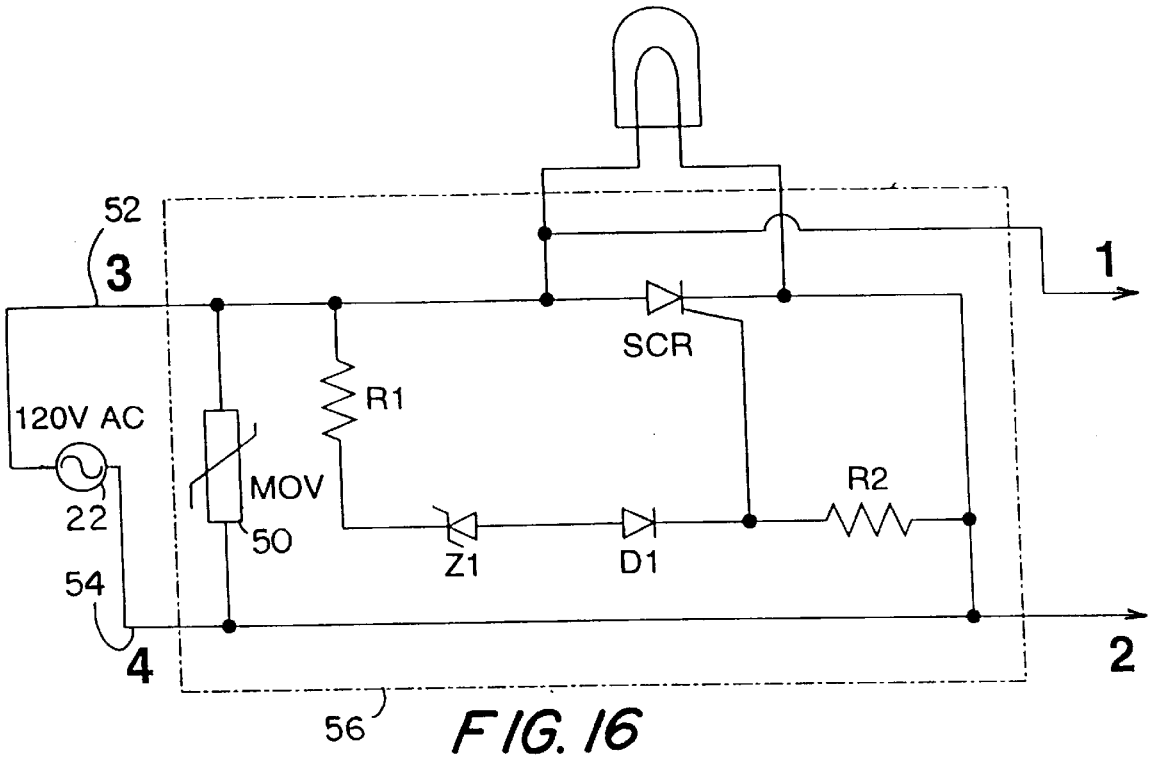
FIG. 16 is an electrical schematic diagram of a 12 Volt module employing an SCR, zener diode and diode as the switching means and a transient voltage surge suppressor (TVSS).

To provide voltage transient protection a metal oxide varistor or MOV 50 is placed across the power supply leads 52, 54 from the 120 Volt AC current source 22 to the modules 56 as shown in FIG. 16. Module 56 is similar to the module of FIG. 7 except that there is a current limiting resistor $R_1$ for zener diode $Z_1$ positioned at the anode of the SCR. Also, a resistor R2 is coupled between the gate and cathode of the SCR to provide a path for anode to gate leakage current to be bypassed to ground thus keeping the SCR from turning on at high temperature. Only a single MOV is required to protect the entire string of load light bulbs. The remainder of the string is made up of modules 58 (see FIG. 17) designated "Y modules" which contain all of the elements of module 56 except for the MOV 50. Alternatively, all of the modules used can be the Y modules 58 connected in series 60 with a single MOV 50 connected across the beginning of the module chain at the lead 52 from power source 22 to the end of such chain 60 of ten 12 Volt load lamps at the lead 54 of source 22 as shown in FIG. 18. This permits a simple means and method for protecting a number of modules located at a common point.

Typical component values and parts used for module 56 were a 60 Volt zener diode for $Z_1$; a 1 Kohm ¼ watt resistor for $R_1$ and $R_2$; the SCR was a TECCOR, PART #S401 E, the diode D1 is part No. 1N4004 and the MOV is 150 Volt, Leviton part #X39676-89-00-00. The components for module 58 are the same as those of module 56 except for the absence of the MOV.

Figure 17:
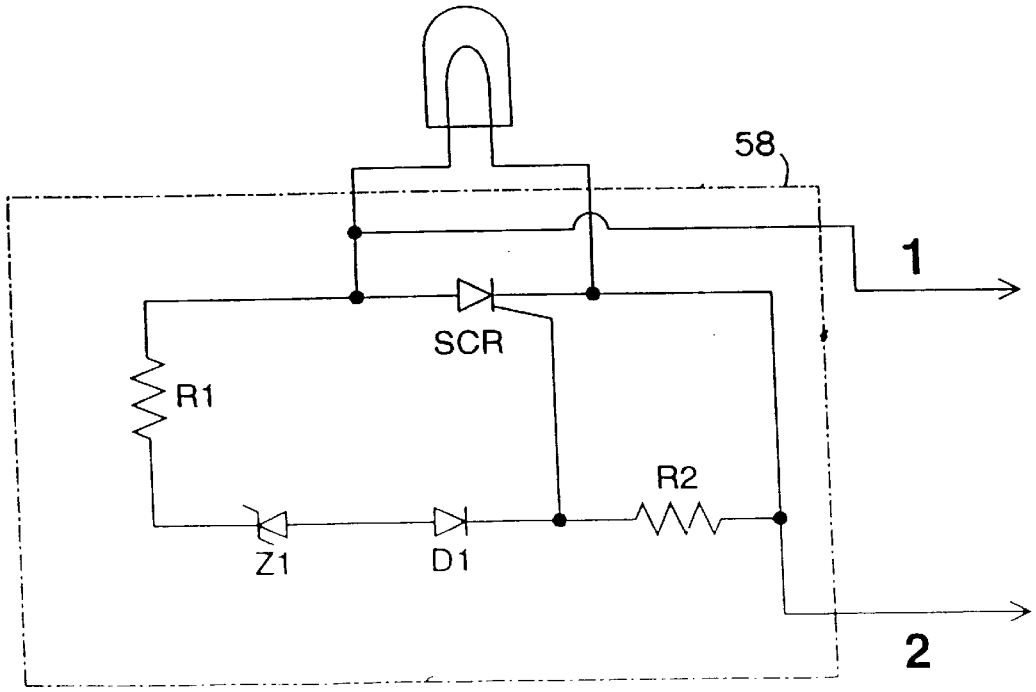
FIG. 17 is an electrical schematic diagram of a 12 Volt module which can be placed in series with the module of FIG. 16.
Figure 18:
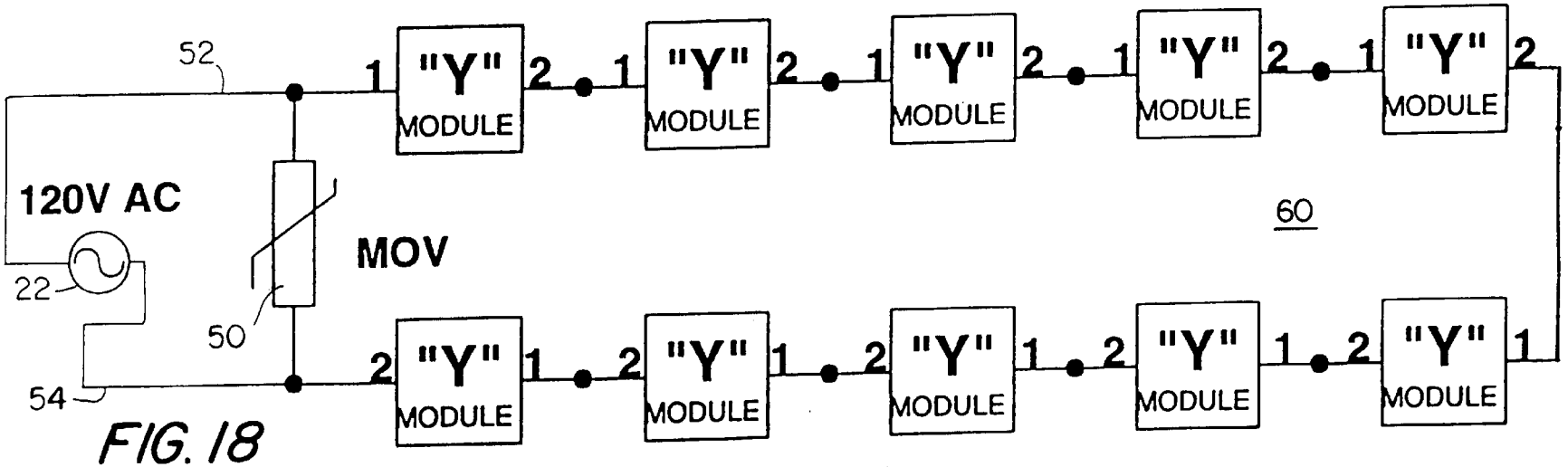
FIG. 18 is a schematic representation of the modules of FIG. 17 connected in series with a TVSS device across the power supply lines.
Figure 19:
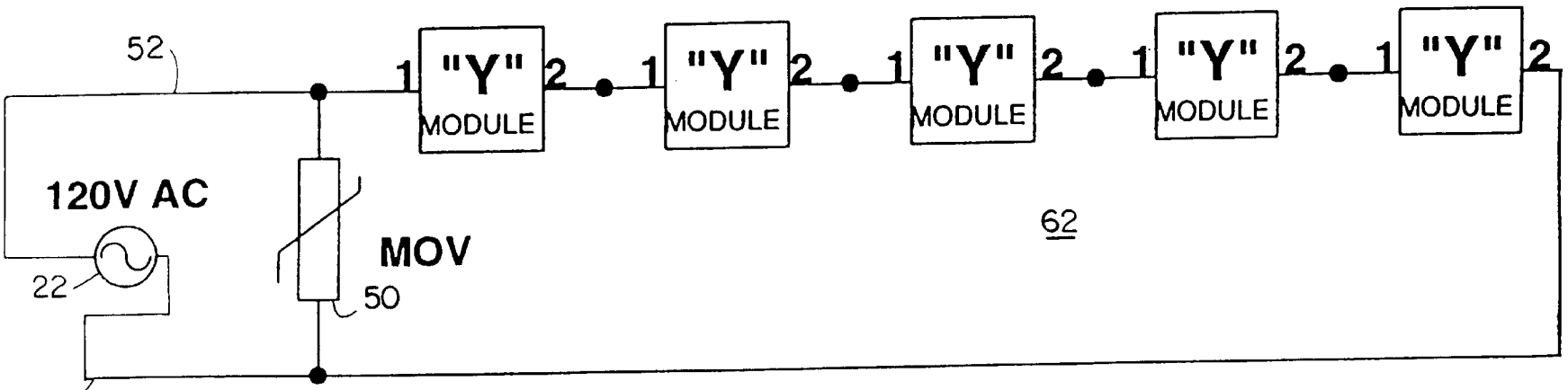
FIG. 19 is a schematic representation of the modules 24 Volt bulbs connected in series with a TVSS device across the power supply lines.

The modules 56 and 58 for a five 24 Volt load lamp strip 62 would be the same as the modules 56 and 58, respectively, of the 12 Volt load lamp strip except that the zener diode Z1 would be rated at 120 Volts instead of the 60 Volt rating of the devices of FIGS. 16 and 17. The MOV 50 is connected from the first input to the first Y module to the output of the last Y module in chain 62. As is well known, the MOVs are generally at a high impedance when subjected to normal operating voltages and conduct little current. At higher voltages, the MOV impedance goes down significantly permitting the current to bypass the load light bulbs chains 60 and 62.

The invention also contemplates the method of powering plural low voltage loads connected in series even when one or more loads stop conducting current. Solid state switching means are connected in parallel with each low voltage load. Current is conducted through one switching means to pass current to the remaining loads when a load in parallel with the switching means stops conducting current. Where each load is a low voltage light bulb, current flows through the circuit to light the remaining light bulbs when one or more light bulb is burned out because the switching means in parallel with the burned out light bulb or bulbs conduct current to the rest of the light bulbs.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

We claim:

1. An electric circuit comprising:

a) plural loads connected in series; and b) plural solid state switching means, each said switching means connected in parallel with one of said loads, and each said solid state switching means comprises a sidac;

c) wherein each said switching means conducts current when the load that it is connected in parallel with does not conduct current.

2. An electric circuit comprising:

a) plural loads connected in series; and b) plural solid state switching means, each said switching means connected in parallel with one of said loads, and each of said solid state switching means comprises a device which is two directional, and has IV characteristics which are symmetrical, and include a breakthrough voltage where current conducts and a sudden decrease in voltage from the breakthrough voltage as current increases in forward and reverse directions;

c) wherein each said switching means conducts current when the load that it is connect in parallel with does not conduct current.

3. The electric circuit recited in claim 2, wherein each said solid state switching means comprises a sidac.

4. The electric circuit recited in claim 2, wherein each said solid state switching means comprises a sidac and a diode is connected in series with the sidac.

5. The electric circuit recited in claim 2, wherein said breakthrough voltage is reached when said load stops conducting current.

6. An electric circuit comprising:

a) plural loads connected in series;

b) plural solid state switching means, each said switching means connected in parallel with one of said loads, and each said solid state switching means has IV characteristics which include a breakthrough voltage where current conducts;

c) wherein each of said switching means conducts current when the load that it is connected in parallel with does not conduct current.

7. The electric circuit recited in claim 6, wherein said breakthrough voltage is reached when said load stops conducting current.

8. An electric circuit comprising:

a) plural loads connected in series; and b) plural solid state switching means, each said switching means connected in parallel with one of said loads, and each of said solid state switching means comprises:

c) a silicon controlled rectifier connected across the load in parallel with the load;

d) an anode of said silicon controlled rectifier at a higher voltage than a cathode of said silicon controlled rectifier; and e) a zener diode connected between a gate and said anode of said silicon controlled rectifier;

f) wherein each of said switching means conducts current when the load that it is connected in parallel with does not conduct current.

9. The electric circuit recited in claim 8, wherein a cathode of said zener diode is connected to said anode of said silicon controlled rectifier and an anode of said zener diode is operatively connected to said gate of said silicon controlled rectifier.

10. The electric circuit recited in claim 9, wherein the anode of said zener diode is connected to the gate of said silicon controlled rectifier via a resistor.

11. An electric circuit comprising:

a) plural loads connected in series;

b) plural solid state switching means, each said switching means connected in parallel with one of said loads, and each said solid state switching means comprises:

c) a silicon controlled rectifier connected across the load in parallel with the load;

d) an anode of said silicon controlled rectifier at a higher voltage than a cathode of said silicon controlled rectifier; and e) a diac connected between a gate and said anode of said silicon controlled rectifier;

f) wherein each of said switching means conduct current when the load that it is connected in parallel with does not conduct current.

12. A method of powering plural low voltage loads connected in series even if one load stops conducting current comprising the steps of:

a) connecting solid state switching means in parallel with each said low voltage load, and each said switching means is a sidac; and b) conducting current through one of said switching means to pass current to the remaining loads when a load in parallel with said switching means stops conduction current.

13. A method of powering plural low voltage loads connected in series even if one load stops conducting current comprising the steps of:

a) connecting solid state switching means in parallel with each said low voltage load, and each said solid state switching means comprises a device which is two directional, and has IV characteristic which are symmetrical, and include a breakthrough voltage where current conducts and a sudden decrease in voltage from the breakthrough voltage as current increases in forward and reverse direction; and b) conducting current through one of said switching means to pass current to the remaining loads when a load parallel with said switching means stops conducting current.

14. The method circuit recited in claim 13, wherein each said solid state switching means comprises a sidac.

15. The method recited in claim 13, wherein each said solid state switching means comprises a sidac and a diode is connected in series with said sidac.

16. The method recited in claim 13, wherein said breakthrough voltage is reached when said load stops conducting current.

17. A method of powering plural low voltage loads connected in series even if one load stops conducting current comprising the steps of:

a) connecting solid state switching means in parallel with each said low voltage load, and each said solid state switching means comprises b) a silicon controlled rectifier connected across the load in parallel with the load;

c) an anode of said silicon controlled rectifier at a higher voltage than a cathode of said silicon controlled rectifier; and d) a zener diode connected between a gate and said anode of said silicon controlled rectifier; and e) conducting current through one of said switching means to pass current to the remaining loads when a load in parallel with said switching means stops conducting current.

18. The method recited in claim 17, wherein a cathode of said zener diode is connected to said anode of said silicon controlled rectifier and an anode of said zener diode is operatively connected to said gate of said silicon controlled rectifier.

19. A method of powering plural low voltage loads connected in series even if one load stops conducting current comprising the steps of:

a) connecting solid state switching means in parallel with each said low voltage load, and each said solid state switching means comprises:

b) a silicon controlled rectifier connected across the load in parallel with the load;

c) an anode of said silicon controlled rectifier at a higher voltage than a cathode of said silicon controlled rectifier; and d) a diac connected between a gate and said anode of said silicon controlled rectifier; and e) conducting current through one of said switching means to pass current to the remaining loads when a load in parallel with said switching means stops conducting current.

20. A method of powering plural low voltage loads connected in series even if one load stops conducting current comprising the steps of:

a) connecting solid state switching means in parallel with each said low voltage load, and each said solid state switching means has IV characteristics which include a breakthrough voltage where current conducts; and b) conducting current through one of said switching means to pass current to the remaining loads when a load in parallel with said switching means stops conducting current.

21. The method recited in claim 20, wherein said breakthrough voltage is reached when said load stops conducting current.

22. A solid state switching circuit coupled in parallel with a low voltage load and across a two line source of AC power so that current flows through said switching circuit when current is not able to flow through said load comprising:

a) a silicon controlled rectifier having an anode terminal, a cathode terminal and a gate terminal;

b) first means for coupling said anode terminal to one side of a load and to one line of said source of AC power;

c) second means for coupling said cathode terminal to the second side of a load and to the second line of said source of AC power; and d) a conduction control circuit connected between said gate terminal and said anode terminal.

23. A solid state switching circuit, as defined in claim 22, wherein said conduction control circuit comprises a zener diode.

24. A solid state switching circuit, as defined in claim 22, wherein said conduction control circuit comprises:

a) a zener diode; and b) a diode.

25. A solid state switching circuit as defined in claim 22, further comprising:

a) a transient voltage surge suppressor coupled across said two lines of said source of AC power.

26. A solid state switching circuit, as defined in claim 22, wherein said conduction control circuit comprises:

a) a zener diode having an anode and a cathode;

b) a diode having a diode anode and a diode cathode;

c) said diode cathode coupled to said gate terminal;

d) said diode anode coupled to said anode terminal; and e) said zener diode anode coupled to said diode anode.

27. A solid state switching circuit, as defined in claim 26, further comprising a resistor between said zener diode cathode and said anode terminal.

28. A solid state switching circuit, as defined in claim 27, further comprising a transient voltage surge suppressor coupled across said two lines of said source of AC power.

29. A system for maintaining current flow through a series connection of a plurality of low voltage loads when at least one of the low voltage loads are non-conducting comprising:

a) a plurality of solid state switching circuits, one for each of said plurality of low voltage loads, each of said solid state switching circuits coupled in parallel with one of said low voltage loads so that current flows through said switching circuit when current is not able to flow through an associated low voltage load;

b) a two conductor source of AC power;

c) each of said solid state switching circuits comprising a silicon controlled rectifier having an anode terminal, a cathode terminal and a gate terminal;

d) first means for coupling said anode terminal of each of said silicon controlled rectifiers to one side of an associated load and to one conductor of said source of AC power;

e) second means for coupling said cathode terminal of each of said silicon controlled rectifiers to the other side of an associated load and to the second conductor of said source of AC power; and f) a conduction control circuit connected between each of said silicon controlled rectifier gate and anode terminals.

30. A system, as defined in claim 29, wherein each of said conduction control circuits comprises a zener diode.

31. A system, as defined in claim 29, wherein each of said conduction control circuits comprises:

a) a zener diode; and b) a diode.

32. A system, as defined in claim 29, further comprising:

a) a transient voltage surge suppressor coupled across said two conductors of said source of AC power.

33. A system, as defined in claim 29, wherein each of said conduction control circuits comprises:

a) a zener diode having an anode and a cathode;

b) a diode having a diode anode and a diode cathode;

c) each of said diode cathodes coupled to an associated silicon controlled rectifier gate terminal;

d) each of said diode anodes coupled to an associated said silicon controlled rectifier anode terminal; and e) each of said zener diode anodes coupled to an associated said diode anode.

34. A system, as defined in claim 33, further comprising:

a) a plurality of resistors, each coupled between an associated said zener diode cathode and an associated said anode terminal.

35. A system, as defined in claim 34, further comprising:

a) a transient voltage surge suppressor coupled across said two conductors of said source of AC power.

36. A solid state switching circuit coupled in parallel with a low voltage load so that current flows through said switch-circuit when current is not able to flow through said load comprising:

a) a silicon controlled rectifier having an anode terminal;

b) first means for coupling said anode terminal to one side of a load;

c) second means for coupling said cathode terminal to the second side of said load; and d) a conduction control circuit connected between said gate terminal and said anode terminal.

37. A solid state switching circuit, as defined in claim 36, wherein said conduction control circuit comprises a zener diode.

38. A solid state switching circuit, as defined in claim 36, wherein said conduction control circuit comprises:

a) a zener diode; and b) a diode.

39. A solid state switching circuit, as defined in claim 36, wherein said conduction control circuit comprises:

a) a zener diode having an anode and a cathode;

b) a diode having a diode anode and a diode cathode;

c) said diode cathode coupled to said gate terminal;

d) said diode anode coupled to said anode terminal; and e) said zener diode anode coupled to said diode anode.

40. A solid state switching circuit, as defined in claim 39, further comprising:

a) a resistor between said zener diode cathode and said anode terminal.

41. A system for maintaining current flow through a series connection of a plurality of low voltage loads when at least one of the low voltage loads are non-conducting comprising:

a) a plurality of solid state switching circuits, one for each of said plurality of low voltage loads, each of said solid state switching circuits coupled in parallel with one of said low voltage loads so that current flows through said switching circuit when current is not able to flow through an associated low voltage load;

b) each of said solid state switching circuits having an input terminal and an output terminal;

c) means to connect said output terminals of said solid state switching circuits to said input terminals of adjacent solid state switching circuits to place said solid state switching circuits in an open ended chain;

d) each of said solid state switching circuits comprising a silicon controlled rectifier having an anode terminal, a cathode terminal and a gate terminal;

e) first means for coupling said anode terminal of each of said silicon controlled rectifiers to one side of an associated load;

f) second means for coupling said cathode terminal of each of said silicon controlled rectifiers to the other side of an associated load; and g) a plurality of conduction control circuits, one for each of said solid state switching circuits, each connected between said silicon controlled rectifier gate and anode terminals.

42. A system, as defined in claim 41, wherein each of said conduction control circuits comprises a zener diode.

43. A system, as defined in claim 41, wherein each of said conduction control circuits comprises:

a) a zener diode; and b) a diode.

44. A system, as defined in claim 41, wherein each of said conduction control circuits, comprises:

a) a zener diode having an anode and a cathode;

b) a diode having a diode anode and a diode cathode;

c) each of said diode cathodes coupled to an associated silicon controlled rectifier gate terminal;

d) each of said diode anodes coupled to an associated said silicon controlled rectifier anode terminal; and e) each of said zener diode anodes coupled to an associated said diode anode.

45. A system, as defined in claim 44, further comprising:

a) a plurality of resistors, each coupled between an associated said zener diode cathode and an associated said anode terminal.

46. A system, as defined in claim 41 wherein:

a) said input terminal of a first of said solid state switching circuits is coupled to one conductor of a source of AC power; and b) said output terminal of the last of said solid state switching circuits in said chain is coupled to the other conductor of said source of AC power.

47. A system, as defined in claim 46, further comprising a transient voltage surge suppressor coupled between said two conductors of said source of AC power.

* * * * *

US005886423C1

(12) EX PARTE REEXAMINATION CERTIFICATE (6716th)

United States Patent
Gershen et al.

(10) Number: US 5,886,423 C1
(45) Certificate Issued: Mar. 24, 2009

(54) ELECTRIC SERIES CIRCUIT

(75) Inventors: Bernard Gershen, Centerport, NY (US); Stanley S. Brenner, East Northport, NY (US)

(73) Assignee: Leviton Manufacturing Co., Inc., Little Neck, NY (US)

Reexamination Request:
No. 90/006,229, Mar. 1, 2002

Reexamination Certificate for:

| | |
|---|---|
| Patent No.: | **5,886,423** |
| Issued: | **Mar. 23, 1999** |
| Appl. No.: | **08/926,856** |
| Filed: | **Sep. 10, 1997** |

(51) Int. Cl.
*H05B 37/00* (2006.01)

(52) U.S. Cl. ..... 307/36; 315/121; 315/122; 315/179; 315/185.5; 327/469; 307/130; 307/116

(58) Field of Classification Search ..... 307/36, 307/116; 315/121, 122, 179, 185.5; 327/469
See application file for complete search history.

(56) References Cited

U.S. PATENT DOCUMENTS 3,345,482 A * 10/1967 Lou ..... 315/122
4,727,449 A * 2/1988 Fleck ..... 361/54
5,453,664 A * 9/1995 Harris ..... 315/185 S
6,084,423 A * 7/2000 Janning ..... 315/122

FOREIGN PATENT DOCUMENTS

FR 2 683 183 * 6/1990

* cited by examiner

*Primary Examiner*—Robert L. DeBeradinis

(57) ABSTRACT

An electric series circuit with plural loads such as light bulbs connected in series and plural solid state switching devices, with each switching device connected in parallel with one of the loads. Each switching device conducts current when the load that it is connected in parallel with does not conduct current because the load is burned out. The solid state switching means may be any device with a breakthrough voltage which is high enough that it does not conduct when all of the loads conduct current normally. When one of the loads is burned out, that load does not conduct current and the entire line voltage appears across the switching means in parallel with the burned out load. The switching means breaks down. Accordingly, the switching means conducts current and current flows to the remaining loads. Accordingly, the remaining light bulbs in a string of light bulbs continue to light. The burned out load may be immediately detected and replaced. The switching means may be a sidac. Alternatively, a combination of an SCR and a zener diode controlling the gate of the SCR are also disclosed as the switching means. A diac may replace the zener diode.

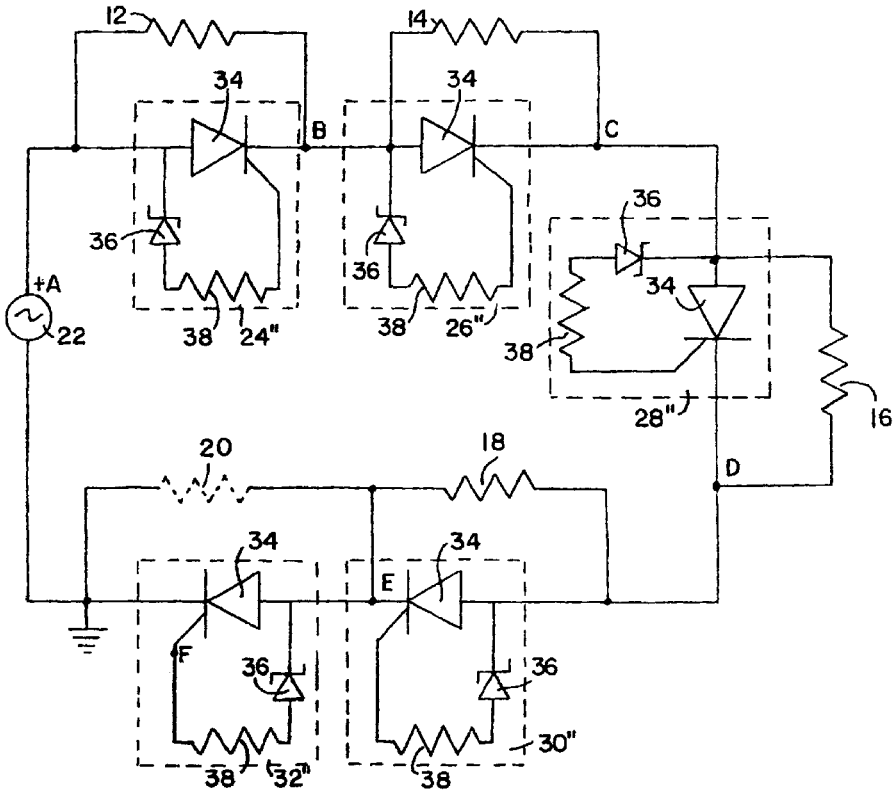

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–11, 17–19 and 22–47 is confirmed.

Claims 1–7, 12–16, 20 and 21 are cancelled.

* * * * *